US011905760B2

(12) United States Patent
Salvador et al.

(10) Patent No.: US 11,905,760 B2
(45) Date of Patent: Feb. 20, 2024

(54) FAST DROP INNER TUBE HEAD ASSEMBLY AND SYSTEM

(71) Applicant: Epiroc Canada Inc., Mississauga (CA)

(72) Inventors: Patrick Salvador, North Bay (CA); Ian D. Wilson, Winnipeg (CA)

(73) Assignee: Epiroc Canada Inc., Mississauga (CA)

( * ) Notice: Subject to any disclaimer, the term of this patent is extended or adjusted under 35 U.S.C. 154(b) by 346 days.

(21) Appl. No.: 17/311,500

(22) PCT Filed: Dec. 7, 2018

(86) PCT No.: PCT/CA2018/051564
§ 371 (c)(1),
(2) Date: Jun. 7, 2021

(87) PCT Pub. No.: WO2020/113307
PCT Pub. Date: Jun. 11, 2020

(65) Prior Publication Data

US 2022/0018192 A1 Jan. 20, 2022

(51) Int. Cl.
*E21B 10/02* (2006.01)
*E21B 10/60* (2006.01)
*E21B 25/00* (2006.01)

(52) U.S. Cl.
CPC ..... *E21B 10/02* (2013.01); *E21B 10/60* (2013.01); *E21B 25/00* (2013.01)

(58) Field of Classification Search
CPC ..... E21B 10/02; E21B 10/60; E21B 25/00
See application file for complete search history.

(56) References Cited

U.S. PATENT DOCUMENTS 5,020,612 A 6/1991 Williams
5,568,838 A * 10/1996 Struthers ..... E21B 47/07 175/246
6,708,784 B1 * 3/2004 Borg ..... E21B 21/10 175/58

(Continued)

FOREIGN PATENT DOCUMENTS

WO 2013110159 A1 8/2013
WO 2013110161 A1 8/2013

(Continued)

OTHER PUBLICATIONS

International Search Report and Written Opinion in corresponding International Application No. PCT/CA2018/051564 dated Jul. 15, 2019 (11 pages).

*Primary Examiner* — Dany E Akakpo
(74) *Attorney, Agent, or Firm* — Sage Patent Group

(57) ABSTRACT

An inner tube head assembly for a core barrel assembly having a latch casing coupled to a latch body, a landing shoulder coupled to the latch body and a spindle, and an inner tube cap assembly coupled between the spindle and an inner tube cap adapter. The landing shoulder and the inner tube cap adapter are a first size. The latch casing, the latch body, the spindle, and the inner tube cap assembly are a second size. The inner tube head assembly includes latches configured to work with the inner tube head assembly of the first size and the drill string of the second size. The first size is larger than the second size. The inner tube head assembly engages a drill string sized to cooperate with the first size. A core drilling system is also described.

27 Claims, 4 Drawing Sheets

(56) References Cited

U.S. PATENT DOCUMENTS

| | | | |
|---|---|---|---|
| 2010/0012383 | A1 | 1/2010 | Drenth |
| 2013/0105227 | A1 | 5/2013 | Drenth |
| 2013/0146365 | A1 | 6/2013 | Salvador et al. |

FOREIGN PATENT DOCUMENTS

| | | | |
|---|---|---|---|
| WO | 2013110162 | A1 | 8/2013 |
| WO | 2014165894 | A1 | 10/2014 |

* cited by examiner

FAST DROP INNER TUBE HEAD ASSEMBLY AND SYSTEM

CROSS-REFERENCE TO RELATED APPLICATIONS

This application is a U.S. National Stage application of PCT/CA2018/051564, filed Dec. 7, 2018 and published on Jun. 11, 2020 as WO 2020/113307, which is hereby incorporated by reference in its entirety.

TECHNICAL FIELD

The present application relates to an inner tube head assembly and system for core drilling operations.

BACKGROUND

In core drilling operations, a core sample is obtained to determine geological information on a particular site. This operation is typically accomplished without removing the drill string from the borehole. For this purpose, hollow drill strings have been developed and include a bit end at the end of the drill string and a core barrel unit positioned proximate the coring bit end. The inner tube assembly unit can be transported through the drill string to avoid having to remove the complete drill string to obtain a core sample. The inner tube head assembly is a sub assembly of the inner tube assembly that locks the inner tube assembly proximate to the coring bit using retractable latches. The inner tube head assembly also allows for the retrieval back to the surface. An overshot is attached to a wireline and is sent down the drill string from the surface to lock on to the head assembly at the bottom of the drill string. The wireline is then hoisted to bring the inner tube assembly, full of core, back to the surface. A flushing fluid is used, usually water, to extract the cuttings from the bore hole and to cool the drill bit. The drill string is filled with fluid and is pressurized from the surface.

Current core barrel assemblies for use in core drilling operations have diameters, sizes, and other dimensions formed or tooled to engage with a particular standard size of drill string. This results in a small clearance between the outer diameter of the tool and the inner diameter of the drill string. Such a small clearance results in low fluid flow around and through the tool, and thus results in low or slow rates of ascent and/or descent in the drill string. The transportation time of the inner tube head assembly and overshot to the bottom of the drill string takes away from the time core is being produced in the core drilling process. Thus, a need exists for an inner tube head assembly formed for improved flow through and around the assembly and formed for improved rates of ascent and descent in the drill string.

BRIEF SUMMARY

According to an embodiment, a core drilling system may include a drill string having a predetermined standardized size; and a core barrel assembly located within the drill string. The core barrel assembly may include an inner tube head assembly having a latch casing coupled to a latch body; latches housing within the latch body; a landing shoulder coupled to the latch body and a spindle; and an inner tube cap assembly coupled between the spindle and an inner tube cap adapter. Wherein, the latch casing, the spindle, and the inner tube cap assembly are a first standardized size, wherein the landing shoulder, the inner tube cap adapter, and the latches are a second standardized size configured to engage the predetermined standardized size of the drill string of the predetermined standardized size, the second size being different from the first size, and wherein the first size is smaller than the second size.

According to an embodiment, an inner tube head assembly for a core barrel assembly may include a latch casing coupled to a latch body; a landing shoulder coupled to the latch body and a spindle; and an inner tube cap assembly coupled between the spindle and an inner tube cap adapter. Wherein the latch casing, the latch body, the spindle, and the inner tube cap assembly are a first size and the landing shoulder and the inner tube cap adapter are a second size, and wherein the first size is smaller than the second size.

According to an embodiment, a core drilling system may include a drill string having a predetermined size; and a core barrel assembly located within the drill string. The core barrel assembly may include an inner tube head assembly having latch casing coupled to a latch body; latches housing within the latch body; a landing shoulder coupled to the latch body and a spindle; and an inner tube cap assembly coupled between the spindle and an inner tube cap adapter. Wherein the inner tube head assembly is configured to create a first clearance gap and a second clearance gap, wherein each of the first clearance gap and the second clearance gap are located between an outer surface of the inner tube head assembly and an inner surface of the drill string, wherein an outer surface of the latch casing, the spindle, and the inner tube cap assembly and the inner surface of the drill string are a first size and create the first clearance gap, and wherein the first size is selected to maximize the first clearance gap to maximize fluid flow around an outer surface of the inner tube head assembly while maintaining structural integrity of the inner tube head assembly.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art would recognize that other equivalent parts can be employed and other methods developed without departing from the spirit and scope of the invention. All references cited herein are incorporated by reference as if each had been individually incorporated.

The present disclosure relates to an inner tube head assembly that is formed of tooling for a standard drill string size and includes enlarged portions. That is, the inner tube head assembly is formed of a standard size for a standard drill string size. The standard size of the inner tube head assembly may be a standard size smaller than the standard size employed for a particular drill string. The remainder of the inner tube head assembly is enlarged to the standard size of the selected drill string to allow for engagement with the inner surface of the drill string. Thus, the inner tube head assembly may be formed of two standard sizes, with one of the standard sizes being a size adapted to engage the size of the selected drill string size or may be formed of one standard size and another size smaller than the standard size. This variable dimension inner tube head assembly is thus specifically structured to provide improved flow through, for example, due to portions having smaller dimensions that conventionally used with the selected drill string. The variable size inner tube head assembly results in increased fluid flow that achieves faster drop times for the inner tube assembly and overshot as compared to conventional wireline inner tube head assemblies. This variable size inner tube head assembly reduces the parts inventory required to warehouse and results in less space to store parts and less parts to purchase for inventory. The inner tube head assembly is adapted to be easily configured to use in the smaller size drill string or the larger size drill string as desired or necessary for a particular drilling process.

Figures 1, 2:
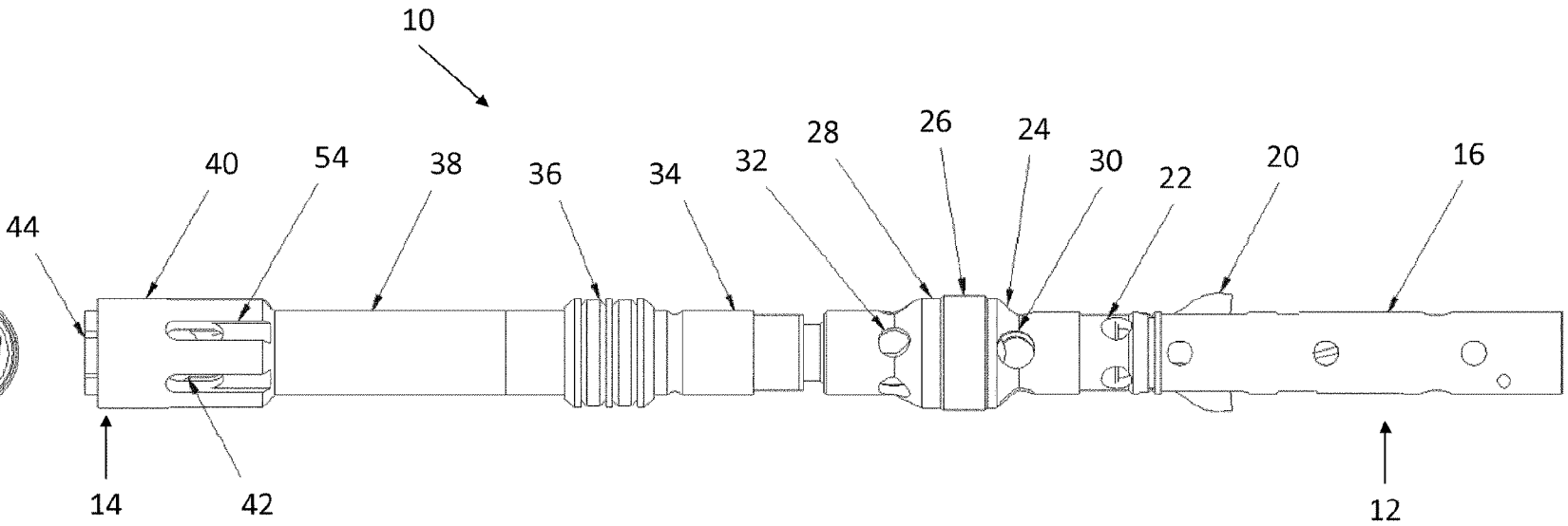
FIG. 1 shows an end view of an inner tube head assembly, according to an embodiment of the present disclosure.
FIG. 2 shows a side view of the inner tube head assembly of FIG. 1, according to an embodiment of the present disclosure.
Figure 3:
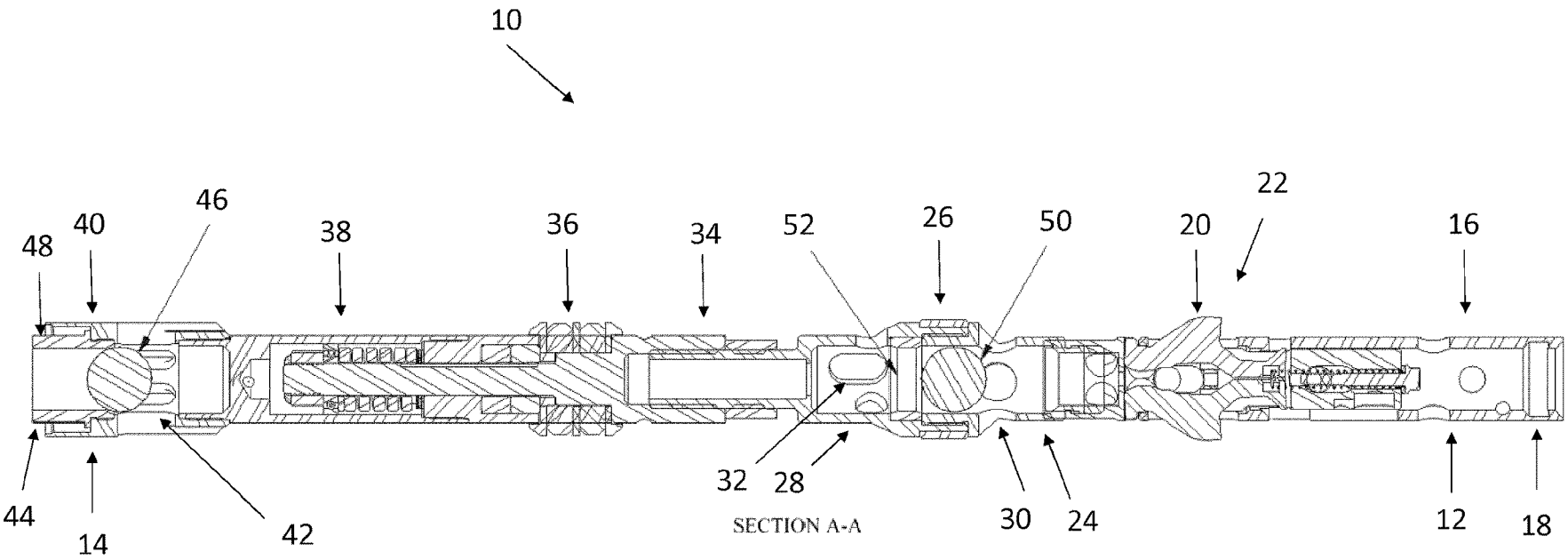
FIG. 3 shows a cross-section of the inner tube head assembly of FIG. 1, taken along the axis A-A of FIG. 1, according to an embodiment of the present disclosure.

Referring to FIGS. 2 and 3, an inner tube head assembly 10 of a core barrel assembly is shown. The outer tube is omitted to facilitate understanding. The inner tube head assembly 10 may include an upper end 12 and a lower end 14. The upper end may include a latch casing, such as a retracting casing 16. The retracting casing 16 may include a profile 18 (FIG. 3) for receiving a retrieval tool, such as an overshot 56 (FIG. 4), as will be described to follow. The inner tube head assembly 10 may include one or more latches 20 housed within a latch body 22. The latch body 22 may be coupled to the retracting casing 16. Although two latches 20 are depicted, more or fewer may be provided.

The inner tube head assembly 10 may include a mid body 24, a landing shoulder 26, and a lower body 28. The mid body 24 may be coupled to the latch body 22 and the landing shoulder 26 may be coupled between the mid body 24 and the lower body 28. The landing shoulder 26 may stop the inner tube head assembly 10 from descending in the drill string. An indication that the inner tube head assembly 10 has reached the desired location in the drill string may be provided by the interaction of the landing indicator ball 50 in the bushing 52, as will be described in more detail. The mid body 24 may include mid body ports 30 and the lower body 28 may include lower body ports 32. The lower body 28 may be coupled to a spindle 34. A shut off valve 36 may be coupled to the spindle 34. The shut off valve 36 may be a rubber shut off valve. An inner tube cap assembly 38 may couple an inner tube cap adapter 40 having ports 42 to the shut off valve 36. The inner tube cap adapter 40 may couple to a check valve assembly 44.

Referring to FIG. 3, a cross-section of the inner tube head assembly 10 taken along the line A-A of FIG. 1 is shown. A check valve assembly 44 may include a ball 46 for seating on a surface of a check valve body 48. The ball 46 may permit fluid flow from the lower end 14, through the check valve body 48 and out of the ports 42. The ball 46 may prevent flow in the opposite direction. Although shown and described as a ball check valve, the check valve assembly 44 may be any valve assembly that permits fluid flow in one direction. The mid body 24 may include a landing indicator ball 50 and a landing indicator bushing 52. The landing indicator ball 50 may be sized to fit within the mid body 24. The landing indicator bushing 52 may be a plastic ring. The ball 46 and the ball 50 may be 1.25 inches.

In an exemplary embodiment, the latches 20 may include a ball insert. The ball insert, not depicted, may be located at the portion of the latch 20 that extends furthest from the inner tube head assembly 10. The ball insert may be the portion of the latches 20 that drags along the inner surface of the drill string. This may reduce friction as the core barrel descends and/or ascends in the drill string. The ball insert may also reduce wear on the latch and may be replaceable. That is, when the ball inserts are worn to a point that they no longer engage the inner surface of the drill string or do not adequately engage the inner surface of the drill string, the ball insert may be replaced. The ball insert may be formed of hardened steel, tungsten carbide, or other metal material. The ball insert may have a low coefficient of friction and high wear resistance.

Although not depicted, the components of the inner tube head assembly 10 may be coupled to adjacent components with threads, complementary shapes, fasteners, or connection types. Alternatively, the inner tube head assembly 10 may be formed integrally or with integral components. For example, the inner tube cap adapter 40 may be formed integrally with the inner tube cap assembly 38. In another example, the mid body 24 may be integral with the latch body 22.

Figure 4:
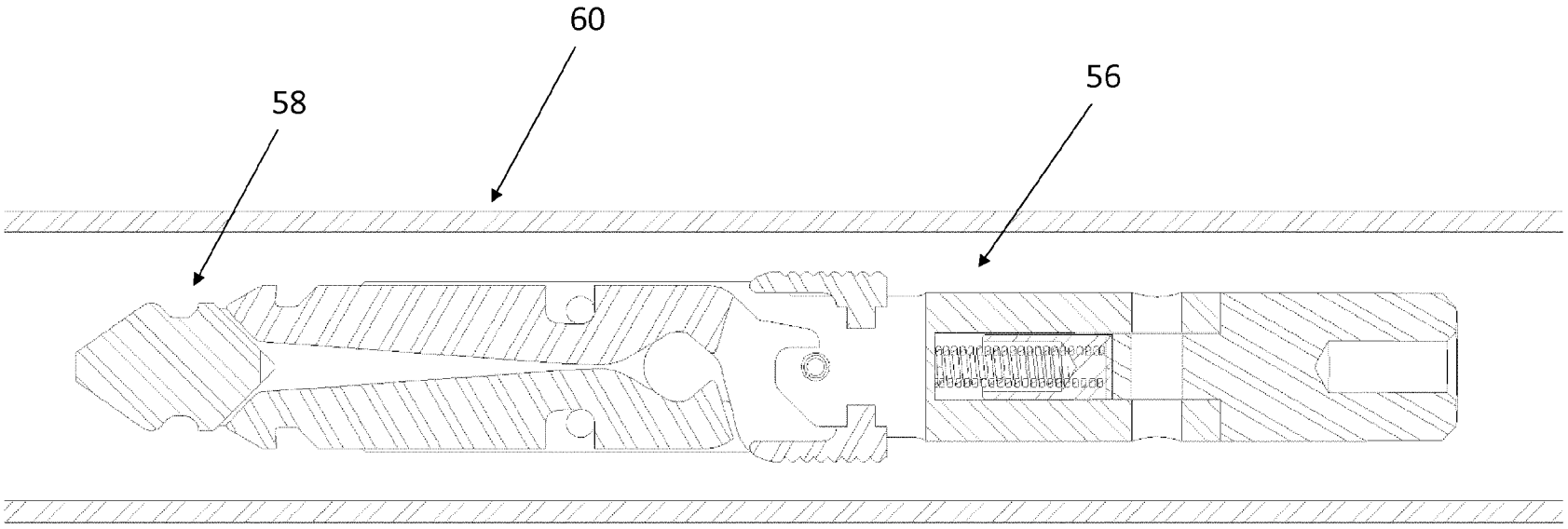
FIG. 4 shows a view of an overshot for an inner tube head assembly, according to an embodiment of the present disclosure.

Referring to FIG. 4, the retrieval tool or overshot 56 is shown. The overshot 56 may include a profile 58 on a lower end of the overshot. The profile 58 may engage the profile 18 (FIG. 1) of the retracting casing 16 thus allowing the overshot 56 to retrieve the inner tube head assembly 10 for retrieving to the surface. The overshot 56 may be lowered into the drill string 60 with wireline. The overshot 56 may be formed of a size that is smaller than the size typically provided for an inner tube head assembly having a landing shoulder, shut off valve, and/or check valve body as sized in the present inner head tube assembly. The smaller sized overshot 56 may have more clearance than the standard size overshot (e.g. a larger overshot). The increased clearance may allow for a faster rate of descent when lowering to retrieve an inner tube head assembly full of core. The overshot 56 in FIG. 4 is exemplary and other tools or methods for retrieving the inner tube head assembly 10 may be provided.

Figure 5:
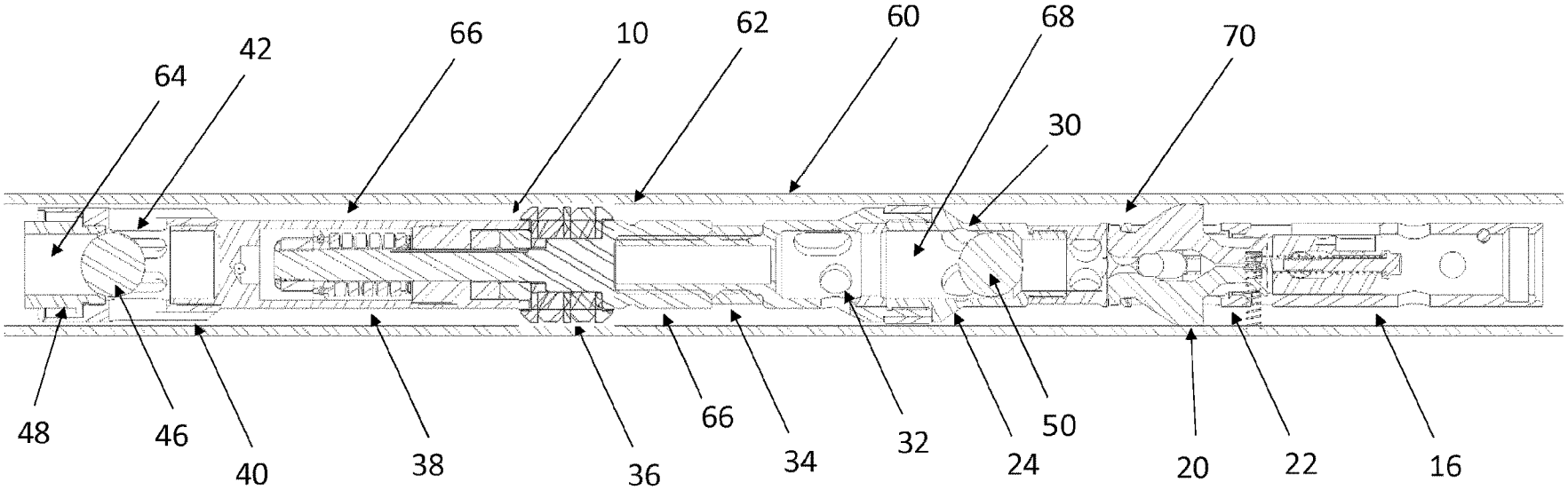
FIG. 5 shows the inner tube head assembly of FIG. 1 in a drill string, according to an embodiment of the present disclosure.

During operation, and referring to FIG. 5, a core barrel assembly, including the inner tube head assembly 10 and an outer tube (not depicted) may be dropped or released from the rig on the ground surface and into the drill string 60 located in the borehole (not depicted). The core barrel assembly with the inner tube head assembly 10 may descend within the drill string 60 in the borehole due to gravity. Alternatively, the inner tube head assembly 10 may be pumped into the borehole. For example, where a borehole extends horizontally, upward, or other direction, the inner tube head assembly 10 may be pumped upwards into the borehole. While descending, the latches 20 may drag along the inner walls or inner surface 62 of the drill string 60. When the core barrel assembly reaches the landing profile (not shown) in the drill string, the landing shoulder 26 of the inner tube head assembly 10 may seat within the landing profile, thus ending descending of the inner tube head assembly 10. When landed, the operator may apply a fluid pressure (e.g. about 1000 PSI) to the landing indicator ball 50. This pressure may push the landing indicator ball 50 through the landing indicator bushing 52 giving an indication to the operator at the surface that the core barrel assembly has reached the desired location.

As the borehole and drill string 60 are typically filled with a drilling fluid (for example, water), the core barrel assembly may descend through the drilling fluid while descending in the drill string 60. The drilling fluid may flow form the bottom of the tool all the way to the top of the tool. Thus, the drilling fluid may flow through and around the inner tube head assembly 10. For example, the drilling fluid may enter the inner tube head assembly 10 through the bore 64 of the check valve body 48. The drilling fluid may unseat the ball 46 permitting the drilling fluid to flow out through the ports 42 of the inner tube cap adapter 40. The drilling fluid may then flow out of ports 42 and travel along the outer surface of the inner tube head assembly 10 in a space 66. Flow groves 54 (FIG. 2) may be provided on the inner tube cap adapter 40 to facilitate fluid flow. The space 66 may be a space between the outer surface of the inner tube head assembly 10 and the inner surface 62 of the drill string 60. The space 66 may be a clearance gap. The space 66 may be substantially annular. The space 66 may extend along the length of the inner tube head assembly 10 such that fluid may flow in the space 66 from the ports 42 to the ports 32 of the lower body 28.

The drilling fluid may continue to flow through the space 66 and along the outer surface of the inner tube head assembly 10, past the inner tube cap assembly 38, shut off valve 36, spindle 34, and into lower body ports 32. The drilling fluid may move the landing indicator ball 50 toward the mid body 24 such that the drilling fluid is allowed to flow within the bore 68 of the mid body 24 and exit the bore 68 out of the mid body ports 30. The drilling fluid may then continue to flow along the outer surface of the inner tube head assembly 10 in a space 70 past the latch body 22, latches 20, and the retracting casing 16. The space 70 may be a space between the outer surface of the inner tube head assembly 10 and the inner surface 62 of the drill string 60. The space 70 may be a clearance gap. The space 70 may be substantially annular. The space 70 may extend along the length of the inner tube head assembly 10 such that fluid may flow in the space 70 from the ports 30 upward along the length of the drill string 60. The space 66 and the space 70 may be fluidly coupled. The space 66 and the space 70 may be one space having variable dimensions.

Each of the components of the inner tube head assembly 10 may include an outer diameter that is tooled, formed, or dimensioned for a particular drill string size. In a conventional wireline core barrel assembly, all of the components of a core barrel assembly are tooled, formed, or sized for the same standard drill string size. Diamond Core Drilling Manufacturers Association (DCDMA) and Metric or Craelius are the most common standards for setting forth drill string standards. Table 1 shows a list of standard drill pipe sizes, according to DCDMA. Although described herein as mixing sizes among a single standard (e.g. including sizes directed to a single standard, such as DCDMA), mixing of sizes between different standards (e.g. DCDMA and Craelius) or between non-standard sizes, or between a standard size and a non-standard size, are contemplated.

TABLE 1

| SIZE | Outer Diameter (mm) | Inner Diameter (mm) |
|---|---|---|
| P | 114.3 | 101.6 |
| H | 88.9 | 77.8 |
| N | 69.9 | 60.3 |
| B | 55.6 | 46 |
| A | 44.5 | 34.9 |

The core barrel assembly, and in particular the inner tube head assembly, may be formed by tooling created for a particular size of standard drill string. That is, when P is the selected drill string, the inner tube head assembly may be formed of tooling specific to the P size drill string. When H is the selected drill string, the inner tube head assembly may be formed of tooling specific to the H size drill string, and so on. The H sized tooling may be smaller than the P sized tooling. The H sized tooling may form an inner tube head assembly that allows for components (e.g. latches, shut off valve) to engage with the inner surface of the H sized drill string or to otherwise function with or cooperate with the H sized drill string, and similarly for the other standard drill string sizes.

For example, conventionally, when an N sized drill string is employed, all components of the inner tube head assembly are tooled or formed specifically for the N size drill string. That is, the inner tube head assembly is tooled or formed to cooperate and engage with the inner diameter of the N sized drill string. Typically, this results in a small clearance between the outer diameter of the inner tube head assembly and the inner wall of the drill string. The clearance is one factor that affects the rate of decent of the core barrel assembly. With a small clearance, less drilling fluid is permitted to flow between the inner tube head assembly and the drill string, thus producing a slower rate of descent as compared to a large clearance. With a large clearance, more drilling fluid is permitted to flow between the inner tube head assembly and the drill string, thus producing a higher or faster rate of descent as compared to the small clearance.

Thus, as described, the inner tube head assembly 10 utilizes parts from an existing, smaller sized head assembly, with an overall small diameter compared to the conventional size for the selected drill string size. The space between the smaller diameter head assembly and the inside of the drill rod allows more fluid to pass through more freely. Certain areas of the inner tube head assembly 10 are adapted to function properly in the drill string, without restricting fluid flow. For example, the inner tube cap assembly 38 is adapted for a larger inner tube using an inner tube cap adapter 40. The inner tube cap adapter 40 includes a check valve assembly 44. The check valve assembly 44 uses a larger diameter ball 46 to block fluid from entering the inner tube during drilling and allow fluid to pass through while dropping down the drill string. The larger check valve ball 46 allows for bigger ports 42 to be used in the check valve body 48 and inner tube cap adapter 40 to maximize fluid flow during dropping.

The shut off valve 36 blocks fluid flow when the core samples pushes on the inner tube head assembly 10, increasing the diameter to push against the inside wall of the drill string, indicating that the inner tube is full or blocked. The shut off valve 36 may be replaced with a solid spacer that has a smaller outside diameter that allows more fluid to flow. Alternately, the shut off valve 36 may be designed (e.g. with a reduced initial diameter) such that the force of the core pushing on the inner tube head assembly 10 results in a substantial increase in diameter, blocking fluid from passing between the shut off valve 36 and the inside of the drill string.

The lower body 28 and mid body 24 secure the landing shoulder 26 and landing indicator bushing 52. The lower body 28 and mid body 24 have been adapted from the smaller sized head assembly to accept the standard landing shoulder 26. The lower body 28 has an increased total port area 32. The lower body 28 has an internal bore to accept a larger diameter landing indicator bushing 52 to allow for more fluid flow, using a larger diameter landing indicator ball 50. The lower body 28 accepts the standard landing shoulder 26 on one end, while maintaining the interaction with the smaller sized spindle 34 on the other end. The mid body 24 has increased port area 30. The mid body 24 secures the larger landing indicator bushing 52 and landing indicator ball 50. The mid body 24 is adapted to secure the standard landing shoulder 26 on one end while maintain the interaction with the smaller sized latch body 22 on the other end.

The latches 20 secure the inner tube head assembly 10 in the core barrel outer tube while drilling. The latches 20 may be adapted to correctly interact with the smaller sized latch body 22 and the standard core barrel while also functioning with the larger diameter drill string. The latches 20 may contain a bead that contacts the inside wall drill rods as the bead travels through the drill string. The bead has reduced friction allowing for faster travel speeds. The bead may rotate or roll as the inner tube head assembly 10 travels through the drill string. The bead may wear down due to this friction, but may be replaced without disassembling the latches 20. The inner tube head assembly 10 uses the retracting casing 16, of the smaller sized head assembly, to be retrieved from the bottom of the drill string. The retracting casing 16 is a smaller diameter that allows more fluid to pass so that it falls through the drill string at a faster rate.

In the inner tube head assembly 10 of the present disclosure, the components are tooled, formed, or sized to maximize the clearance gap between the core barrel assembly and the inner surface of the drill string, while still allowing proper operation and structural integrity. The maximized clearance gap results in a rate of descent for the inner tube head assembly 10 that is faster or greater than a conventional wireline inner tube head assembly. Thus, some components are sized to cooperate and engage with the inner diameter of the particular standard drill string size being used in the borehole and some components are reduced in size. In the example above, where N sized drill string is employed, several of the components of the inner tube head assembly 10 may be formed with N sized tooling while other components may be formed with B sized tooling, one size lower than N size, or a size therebetween. This may result in portions of the inner tube head assembly 10 having a greater clearance between the outer diameter of the inner tube head assembly 10 and the inner surface of the drill string, thus resulting in a higher rate of descent as compared to an inner tube head assembly sized for N size drill pipe alone, with no reduced diameter portions.

In one embodiment, the inner tube head assembly 10 may have portions tooled for the selected standard drill string size. These portions may have a clearance of between about 2 mm and about 3 mm. The inner tube head assembly 10 may have portions tooled for the next lower standard drill string size. These portions may have a clearance of about 8 mm. In some embodiments, the clearance may be between about 5 mm and about 10 mm. In some embodiments, the clearance may be about 5 mm, about 6 mm, about 7 mm, about 8 mm, about 9 mm, or about 10 mm. Thus, the inner tube head assembly 10 may have some portions with a larger clearance between the outer surface of the tool and the inner surface 62 of the drill string 60 and some portions with a smaller clearance between the outer surface of the tool and the inner surface 62.

In some embodiments, the clearance between each of the inner tube cap adapter 40, the landing shoulder 26, and the latches 20 and the inner surface of the drill string may be between about 2 mm and about 3 mm. The clearance between the remaining tool, for example, the spaces 66 and 70, including each of the inner tube cap assembly 38, the lower body 28, the mid body 24, and the retracting casing 16, and the inner surface of the drill string may be about 8 mm. The landing shoulder 26 and inner tube cap adapter 40 may be of the larger size. Accordingly, a larger size ball 46 and/or larger size landing indicator ball 50 may be provided. That is, the inner tube cap adapter 40 and the landing shoulder 26 may be formed of the selected standard drill string size or larger and may accommodate a ball 46 and landing indicator ball 50 of a larger size. Thus, the inner tube cap adapter 40 and the landing shoulder 26 may have a smaller clearance as compared to remaining tool. Furthermore, due to the larger size of the inner tube cap adapter 40 and the landing shoulder 26, the fluid flow through these bodies may be increased. The flow may be the same or may approach the same flow or may have a greater flow as the flow through the spaces 66 and 70. Similarly, the shut off valve 36 may have the smaller clearance. In some embodiments, a spacer may replace the shut off valve 36 and may have the larger clearance.

In an exemplary embodiment, the inner tube cap adapter 40, the landing shoulder 26, the latches 20, the ball 46, and the landing indicator ball 50 may be formed for a first size of drill string. The remaining components, including the inner tube cap assembly 38, the lower body 28, the mid body 24, and the retracting casing 16 may be formed for a second size of drill string. The first size may be larger than the second size. The components formed for the first size may be larger than the components formed for the second size. The first size may be a size that cooperates and engages a first standard drill string size and the second size may be a smaller size than the first standard drill string size. The second size may create a predetermined size to space 66 and/or space 70. The second size may create a space 66, 70 that is larger than a space created between the components of the first size and the inner surface 62 of the drill string 60.

The ratio of the second size (smaller components) to the first size (larger components) may be between about 0.778 and about 0.999, or between about 0.786 and about 0.999, or between about 0.795 and about 0.999, or between about 0.800 and about 0.999. The ratio of the second size to the first size may be about 0.778, about 0.786, about 0.795, or about 0.800. The ratio of the ratio of the first size (larger components) to the second size (smaller components) may be between about 1.286 and about 1.001, or between about 1.272 and about 1.001, or between about 1.257 and about 1.001, or between about 1.249 and about 1.001. The ratio of the first size to the second size may be about 1.286, about 1.272, about 1.257, or about 1.249. In an embodiment, the smaller size is the standard size immediately lower than the first standard size. For example, the first size may be tooled for a P size standard drill string and the second size may be tooled for an H size standard drill string. In another example, the first size may be tooled for an H size standard drill string and the second size may be tooled for an N size standard drill string. In another example, the first size may be tooled for an N size standard drill string and the second size may be tooled for a B size standard drill string.

In an exemplary embodiment, a conventional wireline inner tube head assembly formed to cooperate with a standard N size drill string may have a predetermined rate of descent. In an inner tube head assembly of the present disclosure (e.g. one formed of both standard N size and standard B size as described), the rate of descent may increase between about 125% and about 185% from the rate of descent of the conventional wireline inner tube head assembly when a shut off valve 36 is included in the inner tube head assembly. The rate of descent may increase between about 200% and about 270% from the rate of descent of the conventional wireline inner tube head assembly when the shut off valve 36 is omitted and a reduced diameter spacer is located in place of the shut off valve. In an embodiment, the increase in rate of descent of an inner tube head assembly according to the present disclosure as compared to a conventional wireline inner tube head assembly may be about 100% to about 300%, about 150% to about 275%, about 150% to about 200%, about 250% to about 300%, about 125% to about 200%, or about 200% to about 300%. In an embodiment, the retrieval tool may have an increased rate of descent in any of the aforementioned ranges as compared to retrieval tool provided for the conventional wireline inner tube head assembly.

The increased rate of decent of the inner tube head assembly may result from structural changes to inner tube head assembly or components thereof. The structural changes may affect fluid flow around and/or through the inner tube head assembly thus affecting the rate of decent of the inner tube head assembly.

In some embodiments, the inner tube head assembly may employ a separate support structure to increase rigidity during handling outside of the drill string. In another embodiment, a check valve may be located internally at or near shut off valve 36 to bypass the flow restriction in area around the shut off valve 36 during descent and to block flow during drilling.

In some embodiments, the external surfaces of some or all of the components of the inner tube head assembly may be modified. For example, the inner tube head assembly may employ a polygonal or elliptical shape for the external geometry of some or all of the inner tube head assembly parts (e.g. one or more of the landing shoulder, inner tube cap adapter, etc.) to increase fluid flow while maintaining the correct interaction with a larger diameter drill string. In another example, angled surfaces may be provided to the external surface of inner tube head assembly components and/or to the areas near couplings of components to create smooth transitions from smaller diameter components to larger diameter components and vice versa. In another example, spiral surfaces may be provided to external surfaces of the inner tube head assembly components. This may increase the surface area for the pressurized fluid to push against and create rotational movement of the assembly to increase stability of the head assembly and create smoother fluid flow. In another example, grooves, slots or other indentations may be provided to the external surfaces of the inner tube head assembly components having a larger size. This may allow more fluid to pass through areas having the smaller clearance gap (e.g. by allowing fluid to flow through the grooves), such as the area around the inner tube cap adapter 40, the area around the shut off valve 36, the area around the landing shoulder 26.

In some embodiments, the size and/or shape of some or all of the ports (e.g. inner tube cap adapter ports 42, lower body ports 32, and/or mid body ports 30) may be modified. For example, the ports may be angled, this may provide smoother fluid flow during transfer from exterior of inner tube head assembly to interior and vice versa. In another example, the ports may be spiral (e.g. curve with the circumference of the inner tube head assembly), this may create rotational movement of the assembly to increase stability of the inner tube head assembly and create smoother fluid flow. In another example, the inner tube head assembly may have offset port sizes (e.g. varying port sizes, that is, for example, ports 42 may be offset or may have different sizes), this may direct fluid flow in a specific path for increase efficiency and speed of descent.

In another embodiment, the check valve of inner tube cap adapter 40 may be sized to allow for increased fluid flows into the bore 64 and thus through ports 42. The landing indicator valve may be increased in size and may also allow for increased fluid flow. The increased flow of the check valve and the landing indicator valve, combined with 1) the increased flow through the larger clearance gaps of the spaces 66 and 70 and 2) the increased flow through the smaller clearance gaps of the spaces between the check valve body, shut-off valve 36, and landing shoulder 26, may result in the overall increased rate of descent as compared to a conventional wireline inner tube head assembly. That is, the combination of reduced dimensions, increased port sizes, and increased valve flows, as described herein, may provide for flow to bypass the smaller clearance gap of the larger dimension components.

In one exemplary embodiment, to achieve the increased speeds, components sized for both N size and B size drill strings may be employed, as previously described. The valves and ports of a tool formed of components for both N size and B size drill string may have the following sizes. The check valve ports may have an individual cross-sectional area of the opening of about 0.25 $in^2$ to about 0.5 $in^2$. There may be 6 check valve ports, although more or fewer are contemplated. The total area of the check valve ports may be between about 1.5 $in^2$ and about 3 $in^2$. The lower body ports may have an individual cross-sectional area of the opening of about 0.25 $in^2$ to about 0.5 $in^2$. There may be 5 lower body ports, although more or fewer are contemplated. The total area of the lower body ports may be between about 1.25 $in^2$ and about 2.5 $in^2$. The mid body ports may have an individual cross-sectional area of the opening of about 0.25 $in^2$ and about 0.5 $in^2$. There may be 4 mid body ports, although more or fewer are contemplated. The total area of the lower body ports may be between about 1.0 $in^2$ and about 2.0 $in^2$. The latch body ports may have an individual cross-sectional area of the opening of about 0.25 $in^2$ to about 0.5 $in^2$. There may be 4 lower body ports, although more or fewer are contemplated. The total area of the lower body ports may be between about 1.0 $in^2$ and about 2.0 $in^2$. The check valve may have an inner bore cross-sectional area of about 1 $in^2$ to about 1.25 $in^2$. The landing shoulder may have an inner bore cross-sectional area of about 1 $in^2$ to about 1.25 $in^2$. The cross-sectional area of the space 66 may be between about 2 $in^2$ to about 3.0 $in^2$. The cross-sectional area of the space 70 may be between about 2 $in^2$ to about 3.0 $in^2$.

Although several modifications and alterations to the inner tube head assembly are described for increasing fluid flow and increasing rate of descent of the inner tube head assembly, other modifications are contemplated. Any of the previously described modifications may be applied to some or all of the components of the inner tube head assembly or may be applied to a subset of components of the inner tube head assembly. Any of the previously described modifications may be combined with other modifications and applied to some, all, or a subset of the components of the inner tube head assembly.

In the inner tube head assembly 10 of the present disclosure some components may remain at the size of the standard drill string size being employed in the borehole. For example, the landing shoulder 26 may be tooled for an N size drill string when the N size drill string is employed. Forming the landing shoulder 26 of a smaller size may result in a malfunction of the tool and the landing shoulder 26 may not properly engage with the landing profile in the drill string. Thus, when the particular standard drill string size is selected for the particular borehole, components which interact with the inner surface 62 of the drill string may remain tooled for that particular size. These components may be the inner tube cap adapter 40, the landing shoulder 26, and the latches 20. The remaining components may be reduced in size from the particular standard drill string size.

The inner tube head assembly 10 may also include port sizes that remain at the port size typically employed with a particular standard drill string sizes or may otherwise be enlarged as compared to the reduced size portions of the inner tube head assembly 10. For example, when an N sized drill string is used, the ports 42, 32, and 30 may be formed with the tooling used to create an inner tube head assembly sized for the N sized drill string. Alternatively, the ports 42, 32, and 30 may be larger. The larger ports 42, 32, and 30 may allow for greater fluid flow thus contributing to the faster rate of descent and/or ascent as compared to the conventional wireline inner tube head assembly. The increased port size may accommodate the fluid flow as much as possible, or surpass typical fluid flow, in the first space 66 and bypass in the second space 70. That is, the increase port size may allow for increase flows through the spaces 66 and 70. The port size may allow the same or similar amount or greater amount of flow as the flow present in spaces 66 and/or 70.

Thus the inner tube head assembly 10 of the present disclosure is a variable size and/or variable diameter tool. The inner tube head assembly 10 may be formed of components sized to the selected standard drill string size and to the standard drill string size immediately below the selected standard drill string size. For example, the inner tube head assembly 10 may have components formed or tooled for N size and B size, for H size and N size, or for P size and H size. Reducing the diameter too much, for example, by using a tooling size twice removed (e.g. H size and B size) may result in a tool that has too small of a diameter and cannot support or handle the load caused by the weight of the core being retrieved. Accordingly, the inner tube head assembly 10 may be formed of the selected drill string size and the next smaller size. As mentioned previously, this results in a variable size inner tube head assembly 10. The variable size inner tube head assembly 10 may have the inner tube cap adapter 40, the landing shoulder 26, the latches 20, the ball 46, and the landing indicator ball 50 formed of the selected standard drill string size and the remaining components, including the inner tube cap assembly 38, the lower body 28, the mid body 24, and the retracting casing 16, formed for the next smaller size of standard drill string size. In some embodiments, the next smaller size of standard drill string size may be too small, be too weak and not have sufficient strength to support a core sample retrieved by the assembly. In such cases, the remaining components of the inner tube head assembly 10 may be formed of a size between the selected standard drill string size and the next smaller size of standard drill string size. For example, in some embodiments, where a combination N size and B size tool is desired, the components formed for B size may not support the weight of the retrieved core. Thus, the components engaging the inner surface of the drill string being formed for N size and, instead of B size components, the remaining components may be formed for a size between B size and N size.

The overshot 56 (FIG. 4) may be formed of the same size as the components formed of the smaller size. That is, the overshot 56 may be formed of a size immediately below the selected standard drill string size. In the example above, where the inner tube head assembly 10 is formed for a B size drill string with enlarged portions formed for an N size drill string, the overshot 56 may be formed for an inner tube assembly formed for a B size drill string. Forming the overshot 56 of the smaller size may allow for the overshot 56 to drop at a faster rate and may add to the increased efficiency of the drilling process.

Accordingly, the inner tube head assembly 10 may result in a faster drop rate and may be retrieved back to the surface at a faster rate than a conventional wireline inner tube head assembly. As discussed above, the reduced diameter or size of several components (e.g. the inner tube cap assembly 38, the lower body 28, the mid body 24, and the retracting casing 16) achieves a greater clearance between the inner tube head assembly 10 and the inner surface of the drill string. This allows for more fluid to flow past the tool and achieve a faster rate of descent and/or ascent as compared to an inner tube head assembly tooled for the standard size drill string, without reduced diameter or sized portions. The faster rate of descent and/or ascent reduces non-drilling time and thus may reduce costs associated with drilling.

Accordingly, the inner tube head assembly 10 of the present disclosure reduces the transportation time of the core barrel assembly and improves the efficiency of the core drilling process, allowing for more core to be produced in the same time frame. The inner tube head assembly 10 also reduces parts inventory and warehouse space. The overshot and inner tube head assembly uses common parts for different drill string diameters.

Accordingly, the present disclosure describes an inner tube head assembly and overshot that maximizes fluid flow as they drop down the drill string through the flushing or drilling fluid. The bodies of the assemblies are of a reduced dimension, normally used for smaller diameter drill strings, adapted to work with larger diameter drill strings. The valves and ports are formed to maximize flow and bypass fluid flow restrictions. The latches of the head assembly have an insert that reduces friction and is easily replaced when worn out.

The inner tube head assembly of the present disclosure may be adapted to be easily configured for use in the smaller size drill string. This may be accomplished by removing the larger portions (e.g. the landing shoulder, the tubing cap adapter) and replacing with portions sized for the smaller size drill string. The inner tube head assembly may be adapted to be easily configured to use in a pump configuration of the smaller size or larger size.

Faster drop rates may reduce the non-drilling time, increasing efficiency and the amount of core drilled per shift. With the increased efficiency that this disclosure provides, more core samples may be recovered in the same amount of time as current technology. The fast drop head assembly also reduces the amount of consumables products used during the drilling process. Less fuel is consumed due to less time required to pump the head assembly down the hole. This is also the case with flushing fluid. Many drill sites have water usage restrictions. The higher efficiency of the fast drop head assembly means it is easier to remain within the restricted limits so no extra equipment is need to condition the recirculated water. Because the fast drop head assembly is smaller and lighter than existing head assemblies, it is much easier for the drillers to handle outside of the drill string. This reduces fatigue and chances of injury.

Although the foregoing description is directed to the preferred embodiments of the invention, it is noted that other variations and modifications will be apparent to those skilled in the art and may be made without departing from the spirit or scope of the invention. Moreover, features described in connection with one embodiment of the invention may be used in conjunction with other embodiments, even if not explicitly stated above.

The invention claimed is:

1. A core drilling system comprising:

a drill string having a predetermined standardized size; and a core barrel assembly located within the drill string, the core barrel assembly comprising:

an inner tube head assembly having a latch casing coupled to a latch body;

latches housing within the latch body;

a landing shoulder coupled to the latch body and a spindle; and an inner tube cap assembly coupled between the spindle and an inner tube cap adapter, wherein the landing shoulder and the inner tube cap adapter are a first standardized size configured to engage the predetermined standardized size of the drill string, wherein the latch casing, the spindle, and the inner tube cap assembly are a second size, the second size being different from the first standardized size, wherein the latches are configured to cooperate with the latch body of the second size and the drill string of the predetermined standardized size, and wherein the first standardized size is larger than the second size.

2. The core drilling system of claim 1, wherein the inner tube head assembly is configured to create a first clearance gap and a second clearance gap, and wherein each of the first clearance gap and the second clearance gap are located between an outer surface of the inner tube head assembly and an inner surface of the drill string.

3. The core drilling system of claim 2, wherein an outer surface of each of the latch casing, the latch body, the spindle, the inner tube cap assembly and the inner surface of the drill string create the first clearance gap.

4. The core drilling system of claim 2, wherein an outer surface of each of the landing shoulder, the inner tube cap adapter, and the inner surface of the drill string creates the second clearance gap.

5. The core drilling system of claim 2, wherein the first clearance gap is larger than the second clearance gap, and wherein the first clearance gap allows more fluid to flow past the inner tube head assembly than the second clearance gap.

6. The core drilling system of claim 5, further comprising a check valve in the inner tube cap adapter and a landing indicator valve in a lower body, wherein the check valve and the landing indicator valve are configured to optimize flow to bypass the second clearance gap.

7. The core drilling system of claim 6, wherein the check valve and the landing indicator valve each include a valve seat, one or more valve inlet ports, one or more valve outlet ports, and a valve ball.

8. The core drilling system of claim 2, further comprising a plurality of ports adapted to accommodate the increased fluid flow in the first clearance gap and bypass the second clearance gap.

9. The core drilling system of claim 8, further comprising a landing indicator bushing configured to receive a landing indicator ball, wherein the plurality of ports includes a plurality of ports in a check valve body, a plurality of ports in a lower body, and a plurality of ports in a mid body.

10. The core drilling system of claim 1, further comprising an overshot of second size, the overshot configured to retrieve the inner tube head assembly from a bottom of the drilling string.

11. The core drilling system of claim 1, wherein the second size is a second standardized size configured to engage a different drill string having a smaller predetermined standardized size than the drill string.

12. The core drilling system of claim 1, wherein the latch casing is a retracting casing configured to operate the latches.

13. The core drilling system of claim 1, further comprising an overshot, the overshot formed of a size between the first standardized size and the second size.

14. The core drilling system of claim 1, further comprising an overshot, the overshot formed of a size smaller th.an the first standardized size and adapted to cooperate with the first standardized size, wherein the overshot is sized to optimize fluid flow.

15. The core drilling system of claim 1, wherein the inner tube cap adapter is integral with the inner tube cap assembly.

16. An inner tube head assembly for a core barrel assembly, the inner tube head assembly comprising:

a latch casing coupled to a latch body;

a landing shoulder coupled to the latch body and a spindle; and an inner tube cap assembly coupled between the spindle and an inner tube cap adapter, wherein the landing shoulder and the inner tube cap adapter are a first size and the latch casing, the latch body, the spindle, and the inner tube cap assembly are a second size, and wherein the first size is larger than the second size.

17. The inner tube head assembly of claim 16, further comprising latches located within the latch body, wherein the latches are adapted to couple to the latch body of the second size and engage an inner surface of a core barrel of the first size.

18. The inner tube head assembly of claim 16, further comprising a check valve and a landing indicator valve adapted to maximize fluid flow through the inner tube head assembly.

19. The inner tube head assembly of claim 16, wherein the landing shoulder is coupled to the latch body with a mid body and coupled to the spindle with a lower body, and wherein the mid body and the lower body are adapted to couple the landing shoulder of the first size to the latch body and spindle of the second size.

20. The inner tube head assembly of claim 16, wherein the first size is a size configured for a first standard drill string diameter and the second size is a size configured for a second standard drill string diameter, the first standard drill string diameter being larger than the second standard drill string diameter.

21. The inner tube head assembly of claim 16, further comprising a plurality of ports in the inner tube cap adapter, a plurality of ports in a lower body, and a plurality of ports in a mid body.

22. The inner tube head assembly of claim 16, wherein the inner tube cap adapter is integral with the inner tube cap assembly.

23. A core drilling system comprising:

a drill string having a predetermined size; and a core barrel assembly located within the drill string, the core barrel assembly comprising:

an inner tube head assembly having a latch casing coupled to a latch body;

latches housing within the latch body;

a landing shoulder coupled to the latch body and a spindle; and an inner tube cap assembly coupled between the spindle and an inner tube cap adapter, wherein the inner tube head assembly is configured to create a first clearance gap and a second clearance gap, wherein each of the first clearance gap and the second clearance gap are located between an outer surface of the inner tube head assembly and an inner surface of the drill string, wherein an outer surface of the latch casing, the spindle, the inner tube cap assembly and the inner surface of the drill string are a first size and create the first clearance gap, and wherein the first size is selected to maximize the first clearance gap to maximize fluid flow around an outer surface of the inner tube head assembly.

24. The core drilling system of claim 23, wherein the landing shoulder, the inner tube cap adapter, and the latches are a second size, and wherein the first size is smaller than the second size.

25. The core drilling system of claim 24, wherein the second size is configured to maintain functionality of the inner tube head assembly in the drill string and the core barrel assembly and the first size is configured to maximize fluid flow around the outer surface of the inner tube head assembly.

26. The core drilling system of claim 24, wherein the landing shoulder, the inner tube cap adapter, and the latches are sized for and configured to operate with the predetermined size of the drill string.

27. The core drilling system of claim 24, wherein the inner tube cap adapter is integral with the inner tube cap assembly.

* * * * *